US008474552B2

(12) United States Patent
de Paula Neves et al.

(10) Patent No.: US 8,474,552 B2
(45) Date of Patent: Jul. 2, 2013

(54) PISTON DEVICES AND METHODS OF USE

(75) Inventors: Fabio de Paula Neves, Brasilia (BR); Alex Slocum, Bow, NH (US); Ian David Thomas, Sturminster Marshall (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/350,777

(22) Filed: Jan. 15, 2012

(65) Prior Publication Data

US 2012/0118643 A1 May 17, 2012

Related U.S. Application Data

(63) Continuation of application No. 12/328,711, filed on Dec. 4, 2008, now Pat. No. 8,157,024.

(51) Int. Cl.
*E21B 7/06* (2006.01)

(52) U.S. Cl.
USPC ..... 175/73; 175/61; 175/76; 166/329; 405/143

(58) Field of Classification Search
USPC ..... 175/73, 61, 76, 99, 267, 408; 166/324, 166/328, 329; 137/513.5; 405/143
See application file for complete search history.

(56) References Cited

U.S. PATENT DOCUMENTS

| | | | |
|---|---|---|---|
| 3,250,228 | A | 5/1966 | Knabe et al. |
| 3,326,305 | A | 6/1967 | Garrett et al. |
| 3,366,017 | A | 1/1968 | Firth et al. |
| 3,592,105 | A | 7/1971 | Fryklund |
| 3,636,821 | A | 1/1972 | Rystrom |
| 4,185,704 | A | 1/1980 | Nixon, Jr. |
| 4,416,339 | A | 11/1983 | Baker et al. |
| 4,630,244 | A | 12/1986 | Larronde |
| 4,899,833 | A | 2/1990 | Warren et al. |
| 5,009,273 | A | 4/1991 | Grabinski |
| 5,113,953 | A | 5/1992 | Noble et al. |
| 5,265,682 | A | 11/1993 | Russell et al. |
| 5,437,220 | A | 8/1995 | Cheng et al. |
| 5,520,255 | A | 5/1996 | Barr et al. |
| 5,553,678 | A | 9/1996 | Barr et al. |
| 5,553,679 | A | 9/1996 | Thorp et al. |
| 5,582,259 | A | 12/1996 | Barr et al. |
| 5,582,260 | A | 12/1996 | Murer et al. |
| 5,603,385 | A | 2/1997 | Colebrook et al. |
| 5,655,609 | A | 8/1997 | Brown et al. |
| 5,673,763 | A | 10/1997 | Thorp et al. |
| 5,685,379 | A | 11/1997 | Barr et al. |
| 5,695,015 | A | 12/1997 | Barr et al. |
| 5,706,905 | A | 1/1998 | Barr et al. |

(Continued)

FOREIGN PATENT DOCUMENTS

| | | |
|---|---|---|
| GB | 2234278 | 1/1991 |
| GB | 2408526 | 6/2005 |

OTHER PUBLICATIONS

Examination Report for the equivalent GB patent application No. of 1305112.3 issued on May 15, 2013.

*Primary Examiner* — Shane Bomar
*Assistant Examiner* — Catherine Loikith
(74) *Attorney, Agent, or Firm* — Chadwick A. Sullivan

(57) ABSTRACT

Piston steering devices and methods for use of piston devices. One aspect as disclosed herein provides a ball piston device including: a sleeve in fluid communication with a fluid source and a ball received within the sleeve. The ball is movable within the sleeve from a recessed position and an extended position.

16 Claims, 6 Drawing Sheets

U.S. PATENT DOCUMENTS

| | | | |
|---|---|---|---|
| 5,778,992 | A | 7/1998 | Fuller et al. |
| 5,803,185 | A | 9/1998 | Barr et al. |
| 5,893,318 | A | 4/1999 | Cheng et al. |
| 5,971,085 | A | 10/1999 | Colebrook et al. |
| 6,089,332 | A | 7/2000 | Barr et al. |
| 6,092,610 | A | 7/2000 | Kosmale et al. |
| 6,116,354 | A | 9/2000 | Buytaert |
| 6,116,355 | A | 9/2000 | Thorp et al. |
| 6,158,529 | A | 12/2000 | Dorel |
| 6,244,361 | B1 | 6/2001 | Comeau et al. |
| 6,257,356 | B1 | 7/2001 | Wassell |
| 6,364,034 | B1 | 4/2002 | Schoeffler |
| 6,394,193 | B1 | 5/2002 | Askew |
| 6,595,303 | B2 | 7/2003 | Noe et al. |
| 6,761,232 | B2 | 7/2004 | Moody et al. |
| 6,840,336 | B2 | 1/2005 | Schaaf et al. |
| 6,983,764 | B2 | 1/2006 | Arrowood et al. |
| 7,004,263 | B2 | 2/2006 | Moriarty et al. |
| 7,188,685 | B2 | 3/2007 | Downton et al. |
| 7,353,843 | B2 | 4/2008 | Arrowood et al. |
| 7,389,830 | B2 | 6/2008 | Tumer et al. |
| 2001/0052428 | A1 | 12/2001 | Larronde et al. |
| 2002/0011359 | A1 | 1/2002 | Webb et al. |
| 2006/0000598 | A1 | 1/2006 | Arrowood et al. |
| 2006/0131030 | A1 | 6/2006 | Sheffield |
| 2006/0157283 | A1 | 7/2006 | Hart |
| 2007/0154341 | A1 | 7/2007 | Saenger |
| 2007/0202350 | A1 | 8/2007 | Humphreys et al. |
| 2007/0242565 | A1 | 10/2007 | Hall et al. |
| 2008/0000693 | A1 | 1/2008 | Hutton |
| 2008/0053705 | A1 | 3/2008 | Aronstam et al. |
| 2009/0025930 | A1 | 1/2009 | Iblings et al. |
| 2010/0025116 | A1 | 2/2010 | Hutton |

PISTON DEVICES AND METHODS OF USE

REFERENCE TO RELATED APPLICATIONS

This application is a continuation of U.S. patent application Ser. No. 12/328,711, incorporated herein by reference.

BACKGROUND

Controlled steering or directional drilling techniques are commonly used in the oil, water, and gas industry to reach resources that are not located directly below a wellhead. The advantages of directional drilling are well known and include the ability to reach reservoirs where vertical access is difficult or not possible (e.g. where an oilfield is located under a city, a body of water, or a difficult to drill formation) and the ability to group multiple wellheads on a single platform (e.g. for offshore drilling).

With the need for oil, water, and natural gas increasing, improved and more efficient apparatus and methodology for extracting natural resources from the earth are necessary.

SUMMARY

The invention provides ball piston steering devices and methods for use of ball piston steering devices.

One aspect of the invention provides a ball piston steering device including: a sleeve in fluid communication with a fluid source and a ball received within the sleeve. The ball is movable within the sleeve from a recessed position and an extended position.

This aspect can have several embodiments. The ball can deflect the steering device from a wellbore when in the extended position. The ball piston steering device can also include a bias pad in proximity to the sleeve. The movement of the ball to an extended position can cause the bias pad to rise and deflect the steering device from a wellbore. The bias pad can pivot about a pin. The sleeve can include one or more grooves to exhaust fluid from the fluid source. The fluid source can be a pump. The ball can be a metal ball.

Another aspect of the invention provides a steerable rotary tool including: a rotary cylinder and one or more ball piston steering devices, located on the exterior of the cylinder. Each of the ball piston steering devices includes: a sleeve in fluid communication with a fluid source and a ball received within the sleeve. The ball is movable within the sleeve from a recessed position and an extended position.

This aspect can have several embodiments. The one or more ball piston steering devices can also include a bias pad in proximity to the sleeve. The movement of the ball to an extended position can cause the bias pad to rise. The bias pad can pivot about a pin. The sleeve can include one or more grooves to exhaust fluid from the fluid source. The fluid source can be a pump. The fluid source can be mud from a drill string. The ball can be a metal ball.

Another aspect of the invention provides a method of drilling a curved hole within a wellbore. The method includes providing a steerable rotary tool including a rotary cylinder, a cutting surface, and one or more ball piston steering devices located on the exterior of the cylinder; rotating the steerable rotary tool within the wellbore; and selectively actuating at least one of the one or more ball pistons to deflect the steerable rotary tool from the wellbore, thereby drilling a curved hole within the wellbore. The ball piston steering devices can include a sleeve in fluid communication with a fluid source and a ball received within the sleeve. The ball is movable within the sleeve from a recessed position and an extended position.

This aspect can have several embodiments. The steerable rotary tool can include a bias pad in proximity to the sleeve. The movement of the ball to an extended position can cause the bias pad to rise. The bias pad can pivot about a pin. The sleeve can include one or more grooves to exhaust fluid from the fluid source. The fluid source can be a pump. The fluid source can be mud from a drill string. The ball can be a metal ball.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein:

FIGS. 2C and 2C-1 illustrate a cross-section of a ball piston steering device including a groove to allow fluid to escape from the sleeve in accordance with one embodiment of the invention.

DETAILED DESCRIPTION

The invention provides ball piston steering devices and methods for use of ball piston devices. Some embodiments of the invention can be used in a wellsite system.

Wellsite System

Figure 1:
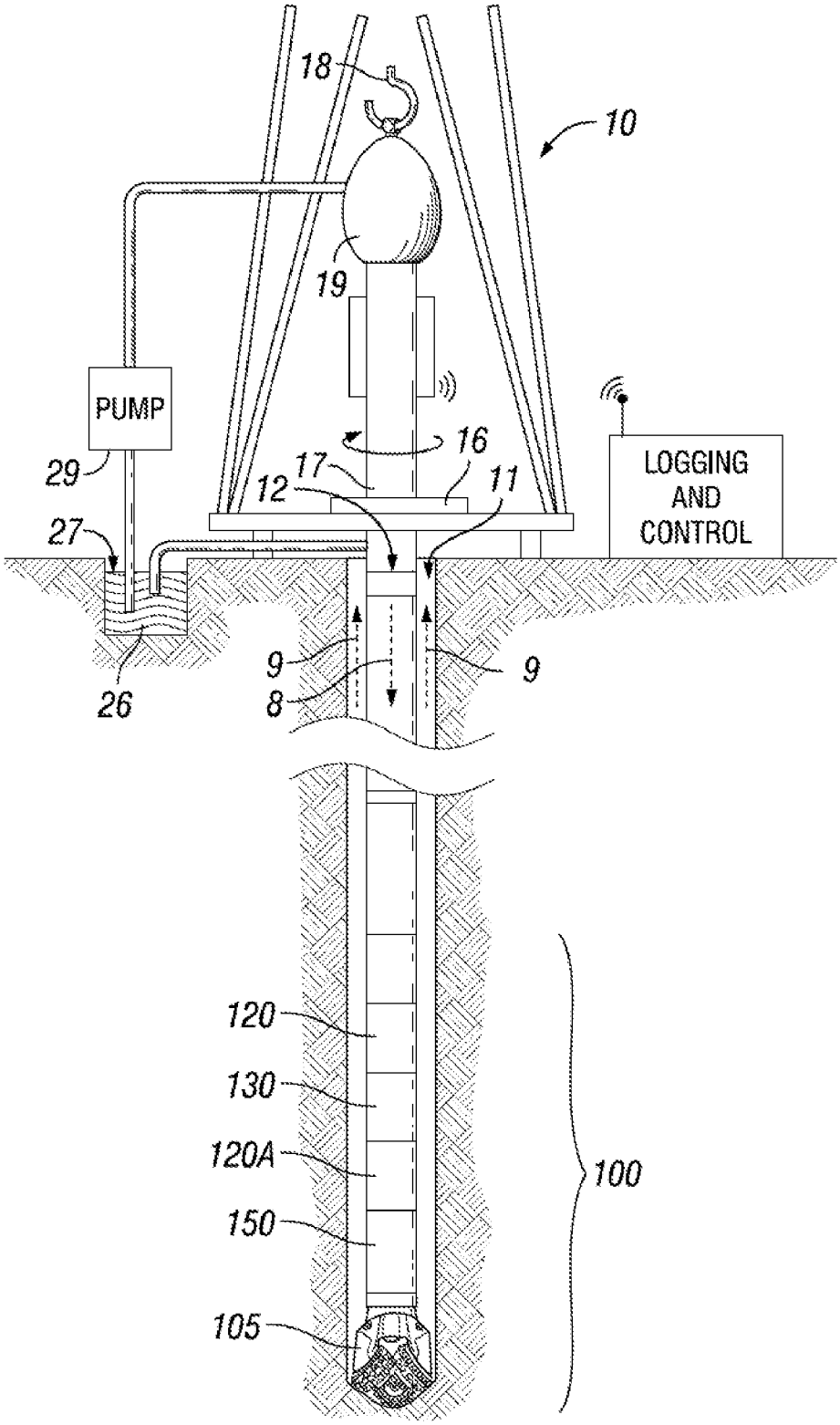
FIG. 1 illustrates a wellsite system in which the present invention can be employed.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator (also known as a "mud motor") powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a rotosteerable subsystem 150 (FIG. 1) is provided. Directional drilling is the intentional deviation of the wellbore from the path it would naturally take. In other words, directional drilling is the steering of the drill string so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of an planned drilling trajectory because of the unpredictable nature of the formations being penetrated or the varying forces that the drill bit experiences. When such a deviation occurs, a directional drilling system may be used to put the drill bit back on course.

A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit is deviated from the local axis of the bottom hole assembly in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Ball Piston Steering Device

Figure 2A:
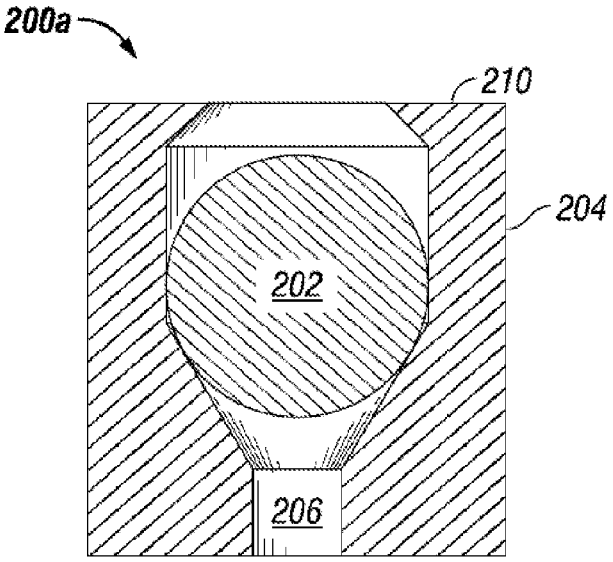
FIG. 2A illustrates a cross-section of a ball piston steering device in a neutral position in accordance with one embodiment of the invention.
Figure 2B:
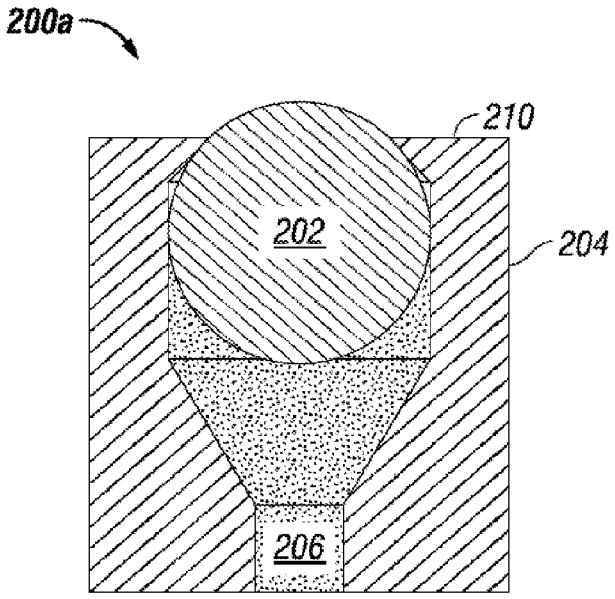
FIG. 2B illustrates a cross-section of a ball piston steering device in an extended position in accordance with one embodiment of the invention.

FIG. 2A depicts a cross-section of a ball piston steering device 200*a* in accordance with one embodiment of the invention. A ball 202 is provided within a sleeve 204. The sleeve includes an orifice 206 for communication with a fluid source. Fluid 208 enters orifice 206 to push ball 202 to an extended position as depicted in FIG. 2B. Lip 210 retains the ball within the sleeve.

When the ball 202 is in the extended position, the ball contacts a wellbore and generates a reactionary force that generally pushes away from the wellbore, thereby effecting a steering force that can be used to steering a bottom hole assembly.

Figures 1, 2C:
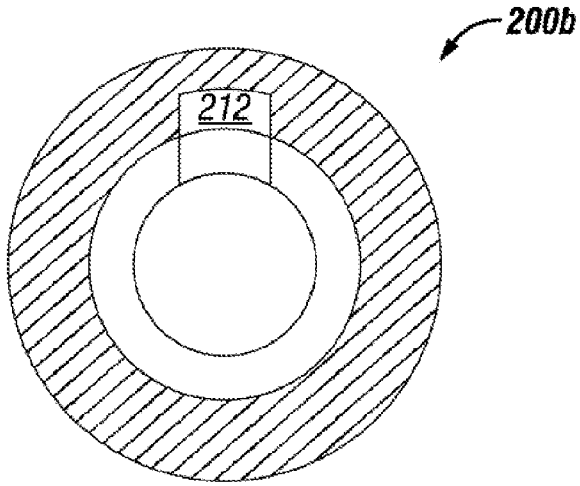
Figure 2C:
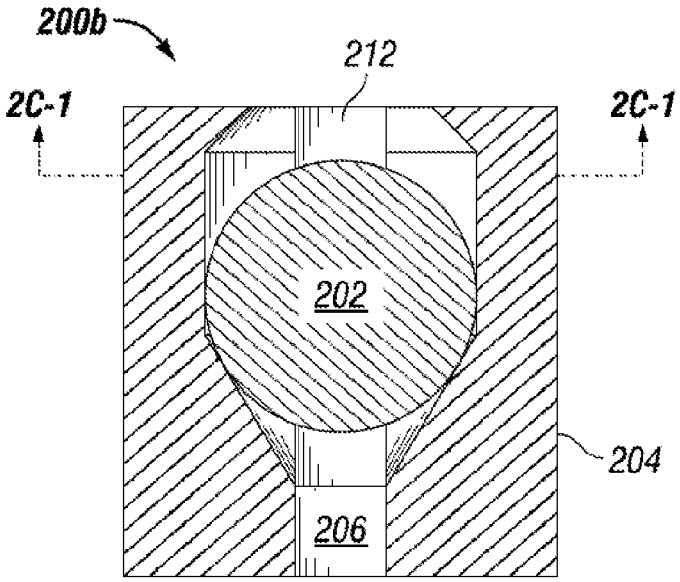

Referring to FIGS. 2C and 2C-1, a ball piston steering device 200*b* is provided in which the sleeve 204 includes a groove 212 to allow the fluid to escape from the sleeve 204. The groove 212 can advantageously provide lubrication for the ball and a bottom hole assembly that the steering device is incorporated in. Additionally, the groove 212 can assist in providing a fluid pathway capable of removing debris in the region of the ball 202 and sleeve 204 interface.

Figure 2E:
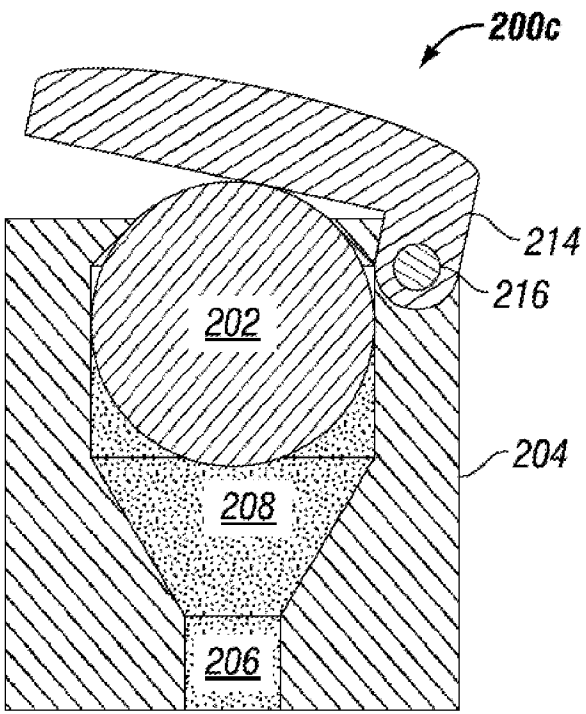
FIG. 2E illustrates a cross-section of a ball piston steering device with a bias pad in an extended position in accordance with one embodiment of the invention.
Figure 2D:
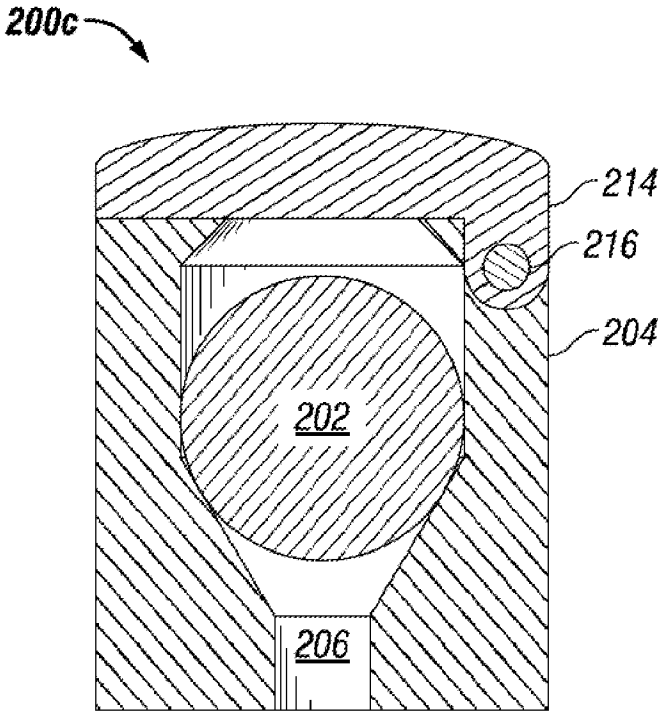
FIG. 2D illustrates a cross-section of a ball piston steering device with a bias pad in a neutral position in accordance with one embodiment of the invention.

Referring to FIG. 2D, a ball piston steering device 200*c* can include a bias pad 214 coupled to the sleeve 204 by a pin 216. Referring to FIG. 2E, when the ball 202 extends, the ball 202 presses against the bias pad 214 to push the bias pad 214 outward. In some embodiments, a spring, such as a torsion spring or an extension spring can act to return the bias pad 214 to an unextended position. One skilled in the art will readily appreciate that the sleeve 204 may be incorporated into a directional drilling tool or rotary directional system 150 of FIG. 1.

Ball 202 and/or bias pad 214 can, in some embodiments, be coated or comprised of a wear-resistant material such a metal, a resin, or a polymer. For example, the ball 202 and/or bias pad 214 can be fabricated from steel, "high speed steel", carbon steel, brass, copper, iron, polycrystalline diamond compact (PDC), hardface, ceramics, carbides, ceramic carbides, cermets, and the like. Suitable coatings are described, for example, in U.S. Patent Publication No. 2007/0202350, herein incorporated by reference.

Figure 3:
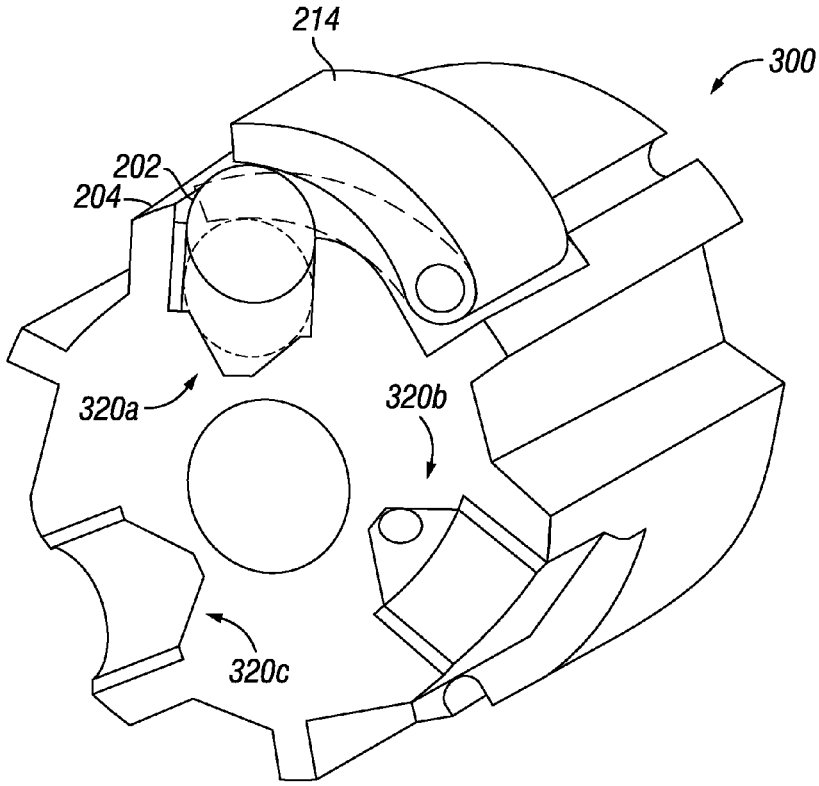
FIG. 3 illustrates a bottom hole assembly component incorporating a ball piston steering device in accordance with one embodiment of the invention.

Referring to FIG. 3, one or more steering devices 302*a*, 302*b*, 302*c* can be integrated into a bottom hole assembly component 300 in a drill string. For example, three steering devices can be arranged approximately 120 degrees apart.

Bottom hole assembly component 300 can further include a control unit (not depicted) for selectively actuating steering devices 302*a*, 302*b*, 302*c*. Control unit maintains the proper angular position of the bottom hole assembly component 300 relative to the subsurface formation. In some embodiments, control unit is mounted on a bearing that allow control unit to rotate freely about the axis of the bottom hole assembly component 300. The control unit, according to some embodiments, contains sensory equipment such as a three-axis accelerometer and/or magnetometer sensors to detect the inclination and azimuth of the bottom hole assembly. The control unit can further communicate with sensors disposed within elements of the bottom hole assembly such that said sensors can provide formation characteristics or drilling dynamics data to control unit. Formation characteristics can include information about adjacent geologic formation gather from ultrasound or nuclear imaging devices such as those discussed in U.S. Patent Publication No. 2007/0154341, the contents of which is hereby incorporated by reference herein. Drilling dynamics data may include measurements of the vibration, acceleration, velocity, and temperature of the bottom hole assembly.

In some embodiments, control unit is programmed above ground to following an desired inclination and direction. The progress of the bottom hole assembly 300 can be measured using MWD systems and transmitted above-ground via a sequences of pulses in the drilling fluid, via an acoustic or wireless transmission method, or via a wired connection. If the desired path is changed, new instructions can be transmitted as required. Mud communication systems are described in U.S. Patent Publication No. 2006/0131030, herein incorporated by reference. Suitable systems are available under the POWERPULSE™ trademark from Schlumberger Technology Corporation of Sugar Land, Tex.

Figure 4:
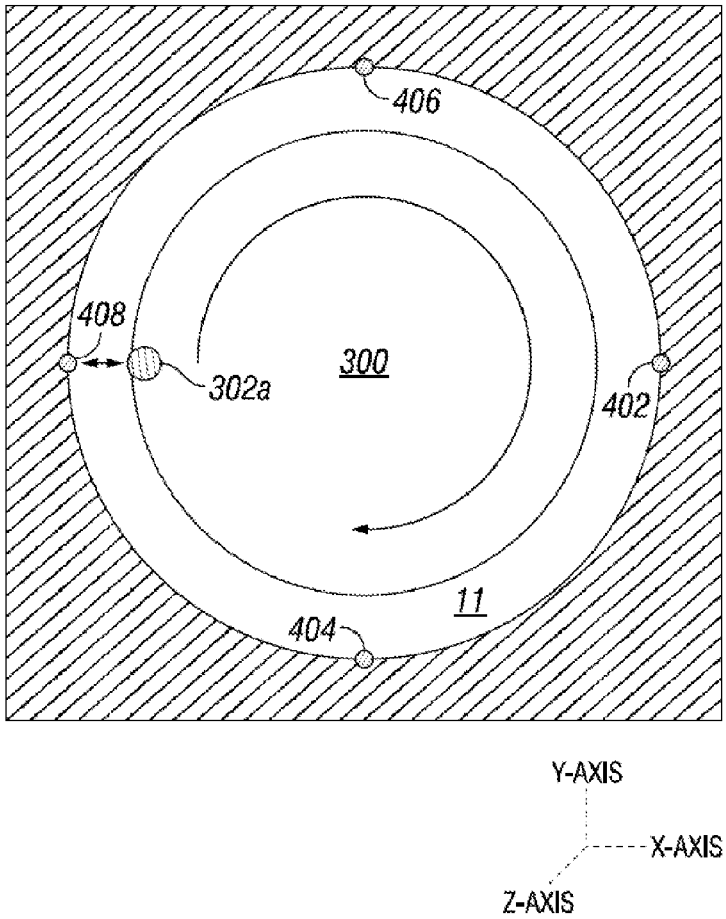
FIG. 4 illustrates the actuation of a steering device in accordance with one embodiment of the invention.

In order to urge the bottom hole assembly component 300 and the entire bottom hole assembly in a desired direction, steering device 302*a* (and, optionally, steering devices 302*b* and 302*c*) is selectively actuated with respect to the rotational position of the steering device 302*a*. For illustration, FIG. 4 depicts a borehole 11 within a subsurface formation. A cross section of bottom hole assembly 300 is provided to illustrate the placement of steering device 302*a*. In this example, an operator seeks to move bottom hole assembly 300 (rotating clockwise) towards point 402, a point located entirely within the x direction relative to the current position of bit body 300. Although steering device 302*a* will generate a force vector having a positive x-component if steering device 302*a* is actuated at any point when steering device 302*a* is located on the opposite side of borehole 11 from point 402 (La between points 404 and 406), steering device 302*a* will generate the maximum amount of force in the x direction if actuated at point 408. Accordingly, in some embodiments, the actuation of steering device 302*a* is approximately periodic or sinusoidal, wherein the steering device 302*a* begins to deploy as steering device passes point 404, reaches maximum deployment at point 408, and is retracted by point 406.

In some embodiments, a rotary valve (also referred to a spider valve) can be used to selectively actuate steering device 302*a* (and 302*b* and 302*c*). Suitable rotary valves are described in U.S. Pat. Nos. 4,630,244; 5,553,678; 7,188,685; and U.S. Patent Publication No. 2007/0242565.

Incorporation by Reference

All patents, published patent applications, and other references disclosed herein are hereby expressly incorporated by reference in their entireties by reference.

Equivalents

Those skilled in the art will recognize, or be able to ascertain using no more than routine experimentation, many equivalents of the specific embodiments of the invention described herein. Such equivalents are intended to be encompassed by the following claims.

The invention claimed is:

1. A piston device comprising:

a sleeve in fluid communication with a particulate laden fluid source; and a loose element received within the sleeve;

wherein the loose element is movable within the sleeve between a recessed position and an extended position; and a bias pad in proximity to the sleeve;

wherein the movement of the loose element to the extended position causes the bias pad to rise and deflect the device with respect to a wellbore and wherein movement of the loose element to the recessed position causes the loose element to disconnect from the bias pad as it moves into the sleeve.

2. The piston device of claim 1, wherein the loose element deflects the device from a wellbore when in the extended position.

3. The piston device of claim 1, wherein the bias pad pivots about a pin.

4. The piston device of claim 1, wherein the particulate laden fluid source is a pump.

5. The piston device of claim 1, wherein the loose element is substantially spherical.

6. A steerable rotary tool comprising:

a rotary cylinder; and one or more piston steering devices, located on the exterior of the cylinder to steer the cylinder during drilling of a wellbore, each of the piston steering devices comprising:

a sleeve in fluid communication with a particulate laden fluid source; and a biasing element a loose element received and trapped within the sleeve, the loose element being in the form of a ball and detached from the biasing element;

wherein the loose element is movable within the sleeve between a recessed position in which the loose element is fully contained within the sleeve and an extended position in which the loose element protrudes from the sleeve while being retained against separation from the sleeve by a member extending inwardly from the sleeve to block further travel of the loose element.

7. The steerable rotary tool of claim 6, wherein the one or more piston steering devices also include:

a bias pad in proximity to the sleeve;

wherein the movement of the loose element to an extended position causes the bias pad to rise.

8. The steerable rotary tool of claim 7, wherein the bias pad pivots about a pin.

9. The steerable rotary tool of claim 6, wherein the particulate laden fluid source is a pump.

10. The steerable rotary tool of claim 6, wherein the particulate laden fluid source is drilling mud.

11. A method of drilling a curved hole within a wellbore comprising:

providing a steerable rotary tool comprising:

a rotary cylinder;

a cutting surface; and one or more piston steering devices, located on the exterior of the cylinder, each of the piston steering devices comprising:

a sleeve in fluid communication with a particulate laden fluid source; and a loose element received within the sleeve and trapped within the sleeve by a lip; and a biasing element;

wherein the loose element is movable within the sleeve from a recessed position in which the loose element is detached from the biasing element and an extended position in which the loose element applies force against the biasing element;

rotating the steerable rotary tool within the wellbore; and selectively actuating at least one of the one or more pistons to deflect the steerable rotary tool from the wellbore, thereby drilling a curved hole within the wellbore.

12. The method of claim 11, wherein the steerable rotary tool includes:

a bias pad in proximity to the sleeve;

wherein the movement of the loose element to an extended position causes the bias pad to rise.

13. The method of claim 12, wherein the bias pad pivots about a pin.

14. The method of claim 11, wherein the particulate laden fluid source is a pump.

15. The method of claim 11, wherein the particulate laden fluid source is drilling mud.

16. The method of claim 11, wherein the loose element is substantially spherical.

* * * * *